US006036436A

United States Patent [19]

Fukuno et al.

[11] Patent Number: 6,036,436

[45] Date of Patent: Mar. 14, 2000

[54] GAS TURBINE COOLING STATIONARY VANE

[75] Inventors: Hiroki Fukuno; Yasuoki Tomita; Kiyoshi Suenaga, all of Takasago, Japan

[73] Assignee: Mitsubishi Heavy Industries, Ltd., Tokyo, Japan

[21] Appl. No.: 09/155,787

[22] PCT Filed: Jan. 21, 1998

[86] PCT No.: PCT/JP98/00206

§ 371 Date: Oct. 2, 1998

§ 102(e) Date: Oct. 2, 1998

[87] PCT Pub. No.: WO98/34013

PCT Pub. Date: Aug. 6, 1998

[30] Foreign Application Priority Data

Feb. 4, 1997 [JP] Japan ..... 9-021341

[51] Int. Cl.[7] ..... F01D 5/18

[52] U.S. Cl. ..... 415/115; 415/116; 415/176; 415/178; 416/96 R; 416/97 R

[58] Field of Search ..... 415/115, 116, 415/176, 178, 177; 416/96 R, 97 R, 96 A

[56] References Cited

U.S. PATENT DOCUMENTS 5,320,483 6/1994 Cunha et al. .
5,743,708 4/1998 Cunha et al. ..... 415/115
5,954,475 9/1999 Matsuura et al. ..... 415/115

FOREIGN PATENT DOCUMENTS 0 392 664 3/1995 European Pat. Off. .
2-241902 9/1990 Japan .
6-257405 9/1994 Japan .
08165902A 6/1996 Japan .
63-63504 4/1998 Japan .

*Primary Examiner*—Edward K. Look
*Assistant Examiner*—Ninh Nguyen
*Attorney, Agent, or Firm*—Alston & Bird LLP

[57] ABSTRACT

There is provided a cooled stationary blade of a gas turbine in which the portions which can be cooled sufficiently by air are air-cooled, and the portions which are difficult to cool by air are steam-cooled, by which high temperatures can be overcome. In a stationary blade 1, there is formed a serpentine passage 3 in which cooling steam flows and an air passage 10 adjacent to the trailing edge portion and separated from the serpentine passage 3. Also, an outside shroud 4 is formed with an air cooling passage 16 at the outer edge portion and a steam impingement cooling portion 17 and an air impingement cooling portion 18 on the inside of the air cooling passage 16. An inside shroud 11 is provided with an air cooling passage 19 at the outer edge portion and shaped holes 20 formed on the inside of the air cooling passage 19. The air flowing out through the shaped holes 20 performs film cooling.

7 Claims, 3 Drawing Sheets

GAS TURBINE COOLING STATIONARY VANE

TECHNICAL FIELD

The present invention relates to a cooled stationary blade of a gas turbine and, more particularly, to a cooling construction of a stationary blade in which cooling is performed by using steam and air as cooling media.

BACKGROUND ART

A stationary blade of a high-temperature gas turbine is cooled by using part of compressed air to keep the blade metal temperature below a temperature which the blade material allows. In order to cool the stationary blade, cooling techniques such as impingement cooling, film cooling, shower head cooling, and pin fin cooling are generally used singly or in combination according to the blade inlet gas temperature.

FIGS. 4 and 5 are a plan sectional view and a perspective view, respectively, showing one example of the present air-cooled stationary blade. In FIG. 4, inserts 53 are installed along the blade profile 51 in the cooled stationary blade. The insert 53 is provided with a cutout 52 at the leading edge portion of the stationary blade.

At the leading edge portion of the stationary blade, shower head cooling 54 is performed from the portion of the cutout 52 provided in the insert 53. The reason why the cutout 52 is provided in the insert 53 at the blade leading edge portion only is that the leading edge portion is a region having a high pressure and it is impossible to blow out air to this portion at a low pressure after impingement cooling, so that air is blown out directly without passing through the insert 53.

At the blade head dorsal portion, blade dorsal portion, and blade ventral portion, impingement cooling 55 and film cooling 56 are performed through the insert 53 as shown in FIG. 4. At the portion where film cooling 56 is performed, the blowout strength must be made proper because, if the cooling air blows out too strongly, the cooling air is mixed with a main gas flow, thereby decreasing the inherent effect of film cooling.

At the blade trailing edge portion, pin fin cooling 58 is performed through pin fin holes 57, and the air after cooling joins with the main gas flow. Thus, the cooled stationary blade of gas turbine is cooled by combining several cooling techniques.

As shown in a perspective view of a cooled stationary blade of FIG. 5, an outside shroud 59 and an inside shroud 60 each have a cooling air inlet hole 61, and a stationary blade 51 lies between the two shrouds 59 and 60. On the surface of the stationary blade 51, ranging from the blade leading edge to the blade trailing edge, holes for shower head cooling, film cooling, and pin fin cooling are formed. Also, the two shrouds 59 and 60 are formed with shroud cooling holes 62.

Nowadays, as the inlet temperature increases with the improvement in gas turbine efficiency, an inlet temperature on the order of 1500° C. cannot be overcome by air cooling only because air has a low heat capacity and a large quantity of air is required for cooling. Therefore, steam begins to be used as a cooling medium because steam has a heat capacity higher than that of air and a relatively small quantity is required for cooling.

For this reason, the stationary blade is configured so that the portions which can be cooled sufficiently by air is air-cooled, and the portions which is difficult to cool by air is steam-cooled. In the case of steam cooling, however, because extraction steam of a steam turbine constituting a combined cycle is used, the leakage of steam into the gas turbine is required to be eliminated for the reason of steam-side cycle.

Therefore, it is required that a cooling medium passage through which steam flows be closed to the outside and have a steam supply port and a recovery port. As an example of the stationary blade of gas turbine in which two kinds of cooling media, air and steam, Japanese Patent Application No. 8-190717 "Stationary Blade of Gas Turbine" has been disclosed.

An object of the present invention is to provide a cooled stationary blade of a gas turbine constructed by a stationary blade, and an outside shroud and inside shroud which hold the stationary blade between them, wherein the portions which can be cooled sufficiently by air is air-cooled, and the portions which is difficult to cool by air is steam-cooled, by which high temperatures can be overcome.

DISCLOSURE OF THE INVENTION

To solve the above problems, the present invention provides a cooled stationary blade of a gas turbine configured as follows. First, for the stationary blade, a serpentine passage having straight and slantwise turbulators, which turns in plural numbers, is provided in the stationary blade, and the serpentine passage is connected to a steam inlet chamber with a steam cooling impingement plate and fins, provided in an outside shroud, and a steam outlet.

Also, at the trailing edge portion of the stationary blade, an air passage formed with slot holes is provided adjacently to the trailing edge portion, which is not connected to the serpentine passage, and connected to an air inlet chamber with an air cooling impingement plate and fins, provided in the outside shroud or an inside shroud.

On the other hand, the outside shroud is air-cooled by providing an air cooling passage having air outlets at the outer edge portion, and is formed with a steam impingement cooling portion at the portion other than the blade profile on the inside of the air cooling passage and air impingement cooling portion at a part of the portion.

Also, the inside shroud is air-cooled by providing an air cooling passage having air outlets at the outer edge portion, and the portion thereof other than the blade profile on the inside of the air cooling passage is impingement-cooled by air and film-cooled by air flowing out through shaped holes.

By being configured as described above, the cooled stationary blade of a gas turbine in accordance with the present invention, which is cooled by using two kinds of cooling media, steam and air, achieves the following effects:

(1) The passage in which cooling steam flows is separated from the passage in which air flows and is closed, and the steam having been used for cooling can be recovered, so that the steam whose temperature is increased by blade cooling can be reused.

(2) By using both of air and steam as cooling media, the quantity of cooling air can be reduced. In addition, because steam has a higher heat capacity than air, the total flow rate of both of steam and air can be decreased as compared with the conventional stationary blade.

(3) By using both of air and steam as cooling media, the quantity of cooling air is reduced, so that the gas turbine efficiency can be improved.

BEST MODE FOR CARRYING OUT THE INVENTION

Figure 1:
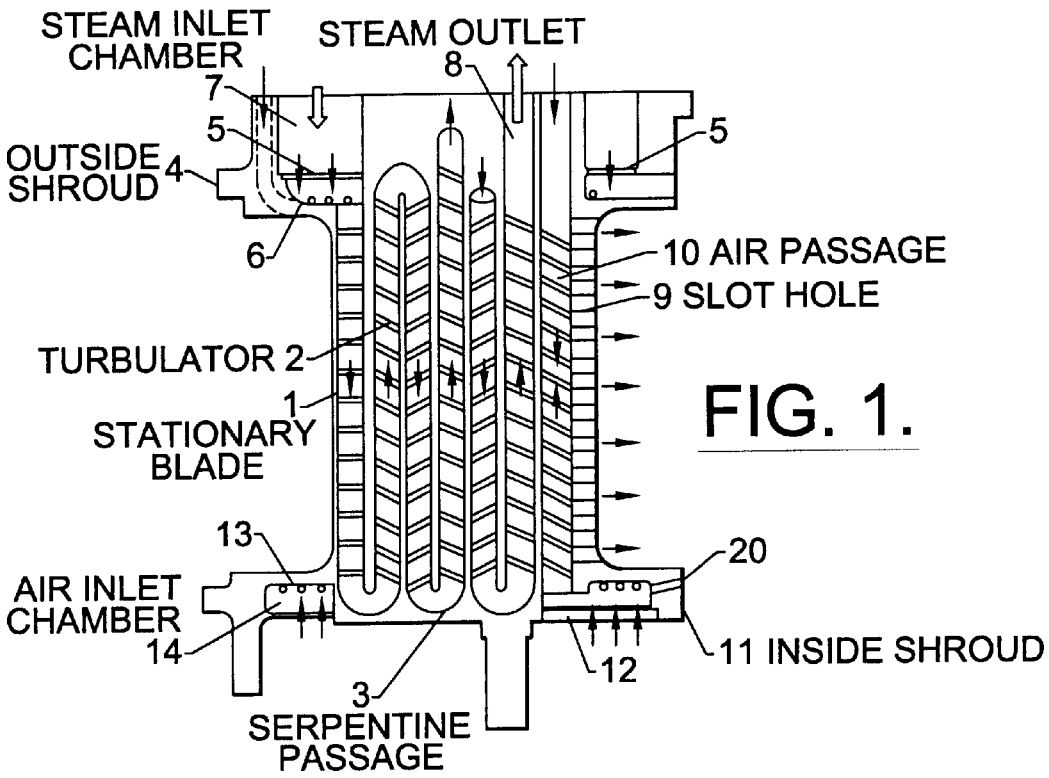
FIG. 1 is a sectional view showing the interior of a cooled stationary blade of a gas turbine in accordance with one embodiment of the present invention.
Figure 2:
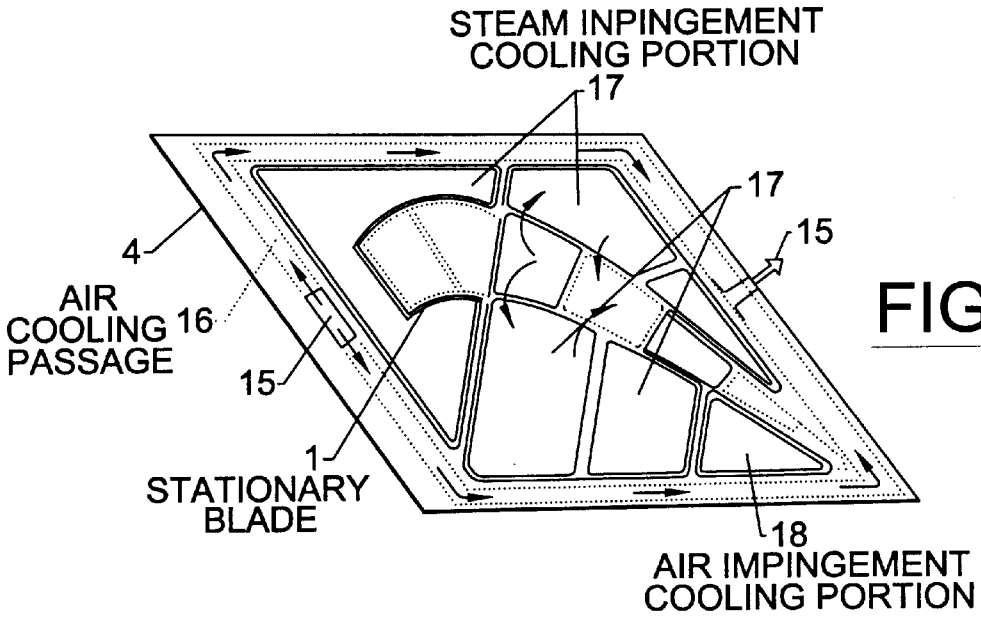
FIG. 2 is a plan view of an outside shroud in the stationary blade shown in FIG. 1.
Figure 3:
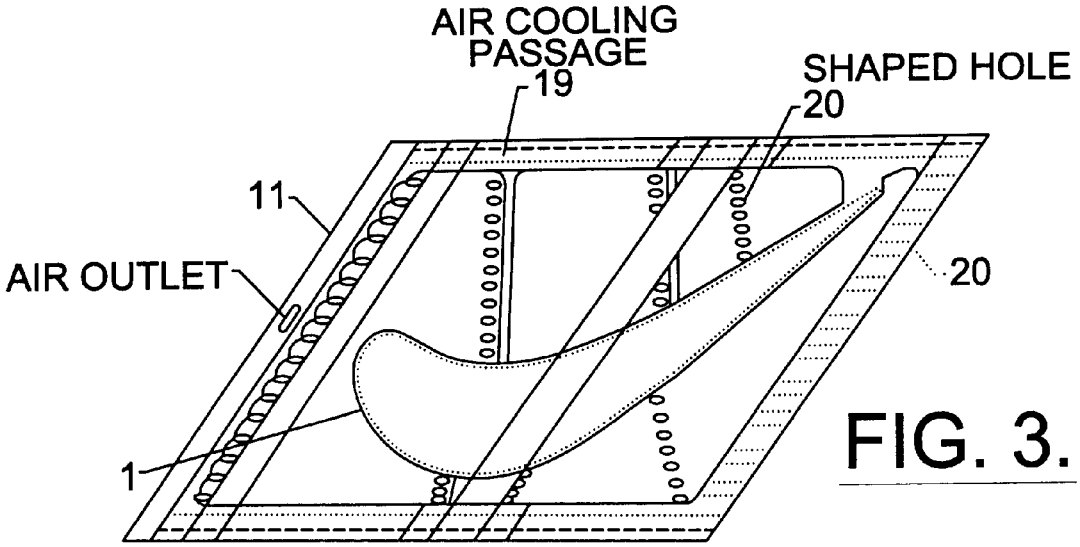
FIG. 3 is a plan view of an inside shroud in the stationary blade shown in FIG. 1.
Figure 4:
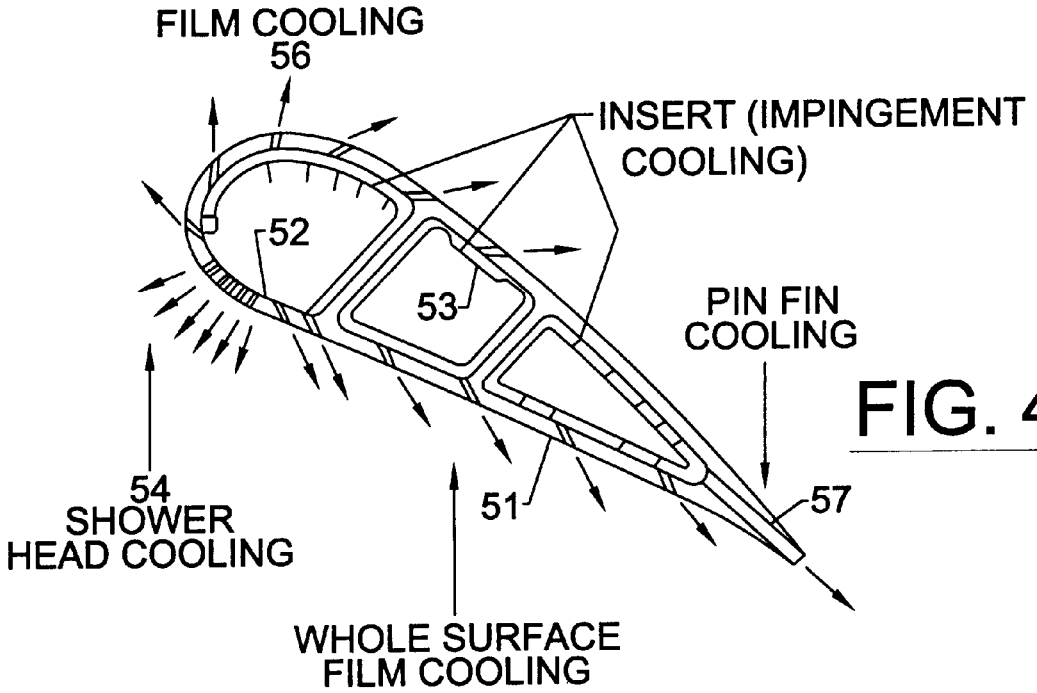
FIG. 4 is a plan sectional view of a conventional air-cooled stationary blade.
Figure 5:
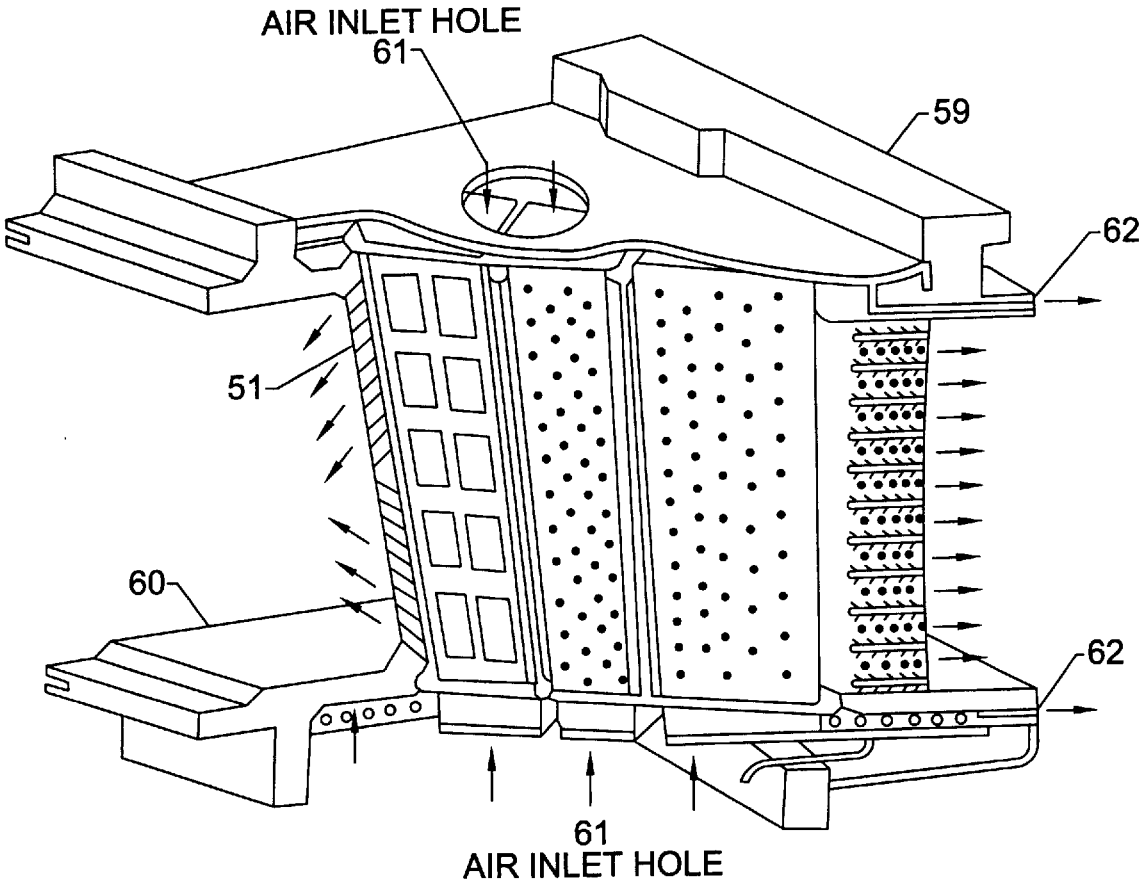
FIG. 5 is a perspective view of a conventional air-cooled stationary blade.

A cooled stationary blade of a gas turbine in accordance with the present invention will be described in detail with reference to one embodiment shown in FIGS. 1 to 3. FIG. 1 is a sectional view showing the interior of a cooled stationary blade of a gas turbine. FIGS. 2 and 3 are plan views of an outside shroud above the stationary blade and an inside shroud below the stationary blade, respectively.

As seen in FIG. 1, in a stationary blade 1, there is provided a serpentine passage 3 having straight and slantwise turbulators 2, which turns in plural numbers. The serpentine passage 3 is connected, on the cooling steam inlet side, to a steam inlet chamber 7 with a steam cooling impingement plate 5 and shroud inside fins 6, which is provided in the outside shroud 4, and connected to a steam outlet 8 on the outlet side.

At the trailing edge portion of the stationary blade 1, slot holes 9 are formed, and an air passage 10 is formed adjacently to the trailing edge portion. This air passage 10 is not connected to the serpentine passage 3, and connected to an air inlet chamber 14 with an air cooling impingement plate 12 and shroud inside fins 13, which is provided in the inside shroud 11.

As shown in FIG. 2, an air cooling passage 16 having a plurality of air outlets 15 is provided at the outer edge portion of the outside shroud 4. Further, the portion other than the blade profile on the inside of the air cooling passage 16 is constructed so that there are formed impingement cooling portions 17 cooled by steam and an impingement cooling portion 18 cooled partially by air.

On the other hand, as shown in FIG. 3, the outer edge portion of the inside shroud 11 is air-cooled by an air cooling passage 19 provided therein, and the portion other than the blade profile on the inside is constructed so as to be film-cooled by the air flowing out through shaped holes 20.

The cooled stationary blade of gas turbine in this embodiment has the aforementioned configuration. The interior of the stationary blade 1 is cooled by cooling steam, which flows into the serpentine passage 3 from the steam inlet chamber 7, passes through the serpentine passage 3, and flows out from the steam outlet 8. Also, the trailing edge portion of the stationary blade 1 is cooled by air, which flows into the air passage 10 from the air inlet chamber 14, passes through the air passage 10, and flows out through slot holes 9.

Also, the outside shroud 4 is cooled by air flowing in the air cooling passage 16 at the outer edge portion of the outside shroud 4, and the portion other than the blade profile on the inside of the air cooling passage 16 is cooled by the steam impingement cooling portion 17 and the air impingement cooling portion 18.

Also, the inside shroud 11 is cooled by air flowing in the air cooling passage 19 at the outer edge portion of the inside shroud 11, and the portion other than the blade profile on the inside of the air cooling passage 19 is film-cooled by air flowing out through the shaped holes 20.

Although the present invention has been described in detail with reference to the embodiment shown in the figures, the present invention is not limited to this embodiment. It is a matter of course that the specific construction and configuration may be modified variously without departing from the scope of the invention defined in the claims.

For example, although the aforementioned embodiment is configured so that cooling air is supplied from the air inlet chamber 14 provided in the inside shroud 11 to the air passage 10 for cooling the trailing edge portion of the stationary blade 1, this cooling air may be supplied from the outside shroud 4, or may be supplied from both of the inside shroud 11 and the outside shroud 4.

INDUSTRIAL APPLICABILITY

As described above in detail, in the cooled stationary blade of gas turbine in accordance with the present invention, the stationary blade is cooled by steam flowing in the serpentine passage and air flowing in the air passage at the trailing edge portion, the outside shroud is cooled by air flowing in the air cooling passage at the outer edge portion and the steam impingement cooling portion and air impingement portion on the inside, and the inside shroud is cooled by air flowing in the air cooling passage at the outer edge portion and film cooling of air on the inside. Thus, cooling is performed effectively by both of steam and air.

Thus, according to the cooled stationary blade of gas turbine in accordance with the present invention, the construction capable of using two kinds of cooling media produces an efficient cooling effect, by which a high gas turbine inlet temperature can be overcome.

We claim:

1. A cooled stationary blade of a gas turbine comprising a stationary blade, and an outside shroud and inside shroud which hold said stationary blade therebetween, the stationary blade having a serpentine passage for carrying cooling steam therethrough, the serpentine passage having a plurality of turns within said stationary blade, the outside shroud having a steam inlet chamber connected to the serpentine passage for supplying steam thereto and a steam outlet for collecting steam which has flowed through the serpentine passage, the trailing edge portion of said stationary blade having an air passage formed with slot holes and connected to an air inlet chamber disposed in one of said outside shroud and inside shroud; said outside shroud including an air cooling passage extending along an outer edge portion of the shroud and having an air outlet, the outside shroud further including a steam impingement cooling portion and air impingement cooling portion disposed between the blade profile and said air cooling passage; and said inside shroud including an air cooling passage extending along an outer edge portion of the shroud and having an air outlet, the inside shroud further including shaped holes connected with the air inlet chamber and disposed between the air cooling passage and the blade profile for film-cooling of the inside shroud.

2. The cooled stationary blade of claim 1, further comprising turbulators within the serpentine passage.

3. The cooled stationary blade of claim 2, wherein the turbulators include straight turbulators and slantwise turbulators.

4. The cooled stationary blade of claim 1, further comprising a steam cooling impingement plate disposed in the steam inlet chamber for steam impingement cooling of the outside shroud.

5. The cooled stationary blade of claim 4, wherein the steam inlet chamber includes fins.

6. The cooled stationary blade of claim 1, further comprising an air cooling impingement plate disposed in the air inlet chamber for air impingement cooling of the respective shroud which houses the air inlet chamber.

7. The cooled stationary blade of claim 6, wherein the air inlet chamber includes fins.

* * * * *